United States Patent [19]

Gartner

[11] Patent Number: 4,555,890

[45] Date of Patent: Dec. 3, 1985

[54] PROCESS FOR THE INSTALLATION OF CURTAIN WALLS AND APPARATUS FOR THE EXECUTION OF THE PROCESS

[75] Inventor: Fritz Gartner, Gundelfingen, Fed. Rep. of Germany

[73] Assignee: Josef Gartner & Co., Gundelfingen, Fed. Rep. of Germany

[21] Appl. No.: 426,920

[22] Filed: Sep. 29, 1982

[30] Foreign Application Priority Data

Oct. 15, 1981 [DE] Fed. Rep. of Germany ..... 3141047

[51] Int. Cl.[4] ..... E04B 1/00

[52] U.S. Cl. ..... 52/745

[58] Field of Search ..... 52/741, 742, 743, 744, 52/745, 746, 747, 748, 749, 750, 235, 90, 92, 122.1, 125.1, 125.2

[56] References Cited

U.S. PATENT DOCUMENTS

| | | | |
|---|---|---|---|
| 3,252,199 | 5/1966 | Bossner | 52/743 |
| 3,748,805 | 7/1973 | Boros | 52/745 |
| 3,791,094 | 2/1974 | Shannon, Jr. | 52/747 |
| 4,056,912 | 11/1977 | Case et al. | 52/745 |
| 4,219,978 | 9/1980 | Brown | 52/745 |
| 4,320,985 | 3/1982 | Kleinemas | 52/749 |

FOREIGN PATENT DOCUMENTS

| | | | |
|---|---|---|---|
| 1246982 | 8/1967 | Fed. Rep. of Germany | 52/745 |
| 980940 | 5/1951 | France | 52/745 |
| 55229 | 10/1951 | France | 52/745 |
| 1009630 | 6/1952 | France | 52/745 |
| 1238437 | 7/1960 | France | 52/745 |
| 1062785 | 3/1967 | United Kingdom | 52/745 |

*Primary Examiner*—Donald G. Kelly
*Assistant Examiner*—Andrew Joseph Rudy
*Attorney, Agent, or Firm*—Jerome P. Bloom

[57] ABSTRACT

The invention basically provides for the installation of a curtain wall of a building using prefabricated wall elements of reasonable size provided in the interior of the building, on an existing floor thereof, while construction is taking place. Each wall element is carried across the floor where it is located on a car or cart by means of which it is presented at the edge of this floor, immediately of the outer side of the building and to the front thereof. At this point it is hung on suspension apparatus for movement to its place of installation. While so hung it is fastened to the building at its required location, subsequent to which it is released from the suspension apparatus. The suspension apparatus utilized is preferably a monorail trolley. The wall elements preferably have a post and tie bar construction and are preassembled on an auxiliary frame in a mannner to facilitate their connection to form a curtain wall and in this process to satisfy the requirements for ease in application of sealing and to provide expansion joints. The car or cart employed for transport of each wall element embodies structural means not only to hold a wall element thereon in a secure position during transport but to provide for its manipulation and pivoting to a vertical position for its connection to suspension apparatus.

14 Claims, 11 Drawing Figures

PROCESS FOR THE INSTALLATION OF CURTAIN WALLS AND APPARATUS FOR THE EXECUTION OF THE PROCESS

BACKGROUND OF THE INVENTION

This invention relates to a new and improved process for the construction and installation of a curtain wall made up of prefabricated wall elements and apparatus for the execution of this process.

In principle two different processes are known for the erection of a facade of curtain walls. In one type of construction the entire curtain wall consists of individual wall elements which present the height of one or more stories of the building being constructed. These elements are self supporting and are fastened, for example, to the floor ceilings of the building. The mounting of these wall elements may be carried out using a cable winch or a crane. For this the wall elements are hoisted from ground level on the outside of the building. The hoisting can be carried out only very slowly and, because of their relatively large surface area, during this procedure the elements are exposed to and subject to the influence of existing wind forces, making them difficult to control. This mode of construction is time consuming and during the same both the wall elements to be installed and the wall elements already installed are exposed to the possibility of damage, which often occurs.

Another method of erecting a facade consists of joining, directly to the outside of the building, posts and tie bars for carrying glazing and facade panels. This work is also very time consuming and requires the presence of a suspended car or gondola which must be arranged to move in all directions on the outside of the building. There is hazard to installers during the construction of the facade.

Underlying the invention is the problem of finding a process, and apparatus for the execution of the process, by means of which the curtain wall of a building can be erected in the shortest possible time and with the least cost, without concern for the safety of the workers and without damage to the wall elements or their components. The present invention does provide a solution to this problem.

SUMMARY OF THE INVENTION

The invention provides that a curtain wall of a building shall be formed from a plurality of wall elements which prior to the time the installation of the curtain wall is required will be made available within the building, on a floor or floors thereof. According to a process of the invention each wall element will be individually moved from its location within the building, across the floor thereof, and presented at an outer side of the building, immediately in front thereof. At this point the wall element will be placed in a vertical position, in an orientation in which it will be installed, and connected to and suspended from a trolley or hoisting apparatus. By reason of its suspension, the wall element can then be quickly and easily moved the reasonably short distance required to establish it at its place of installation, where it is fastened to the building. In accordance with a preferred form of execution of the invention process an assembly comprising a wall element will be placed on a cart having an approximately horizontal supporting surface with the vertical axis of the element running parallel to the longitudinal axis of the cart and with about one-half of its longitudinal extent, along its vertical axis, projected beyond one end of the cart. By reason of an appropriate connection of the wall element with the cart, as it is presented at the outer side of the building the wall element can be pivoted with reference to what is approximately its mid-axis to swing it from its horizontal position to a vertical position, so it can then be suspended and with release thereof from the cart be guided to the location of the building where it is fastened. The pivoting of the wall element here required may be aided by use of hydraulic cylinder means. In any case the special positioning of the wall element on the cart and with respect thereto insures that the forces necessary for swinging this element into a vertical position are kept low. Due to the location of the wall element immediately of the front of the outer side of the building when suspended and the relatively short distance that it need be moved to reach the location of its installation, the guidance of the element in front of the outer side of the building can be accomplished or assisted by workers positioned on the various floors of the building, inside the railing provided at the outer edges thereof. The procedure is easy to carry out, and affords insurance against damage to the wall elements and is free of hazard to the workers.

In another preferred form of execution of the invention process a car or cart mounting a pivotally related boom is used to move the wall elements from the place of their location to a position immediately exterior to an outer side of the building. In the use of such apparatus each wall element is taken up by the boom of the car with the vertical axis of the element running horizontally. The element is moved into an approximately horizontal position, supported by the boom and the position thereof is maintained as the car is driven across the floor to present the wall element immediately of an outer side of the building, in front thereof. The construction and arrangement of the support of the wall element on the boom provides that the wall element may be swung and rotated as required until its vertical axis assumes a vertical position, whereupon the element is hung on suspension apparatus, such as a hoisting device or trolley. As soon as this is achieved, the wall element is released from the boom and then moved to the place of its fastening to the building. So that the dimensions of the boom can be kept relatively short, in the use thereof to pick up a wall element it is swung into an approximately horizontal position, so that it can be projected out over the landing provided on the outer edge of the floor on which it is located to cause the wall element to be presented at the outer side of the building. Once the wall element stands out from the building suitable controls in connection with the boom are operated to provide that the surface of the wall element runs parallel to the outer side of the building, whereupon it can be turned from its horizontal position through 90° on the boom arm until its longitudinal axis assumes a vertical position.

It is preferred that the device used for suspending the wall element exterior to the building be a monorail trolley mounted in connection with the building at a level above the floor on which the wall elements are located within the building.

In order to simplify the procedure for fabrication and mounting of a curtain wall to a building and to reduce its cost, the invention provides that the curtain wall be made of a plurality of preassembled wall elements which are modest in size and exhibit a post and tie bar construction. To this end posts and tie bars, as well as other parts which may be required to form a curtain wall, will be brought to a building at an early stage in its construction, when the posts and tie bars can be stored on a selected floor or floors thereof. The posts and tie bars will then be assembled into individual wall elements where these parts have been previously stored, a convenient and safe location for an assembler. For the assembly thereof it is preferred that the posts and bars be mounted on an auxiliary frame. The posts and the bars are applied to this auxiliary frame in the arrangement and configuration required and the posts are releasably connected to this frame by screws. As thus prefabricated, the wall element may then, together with its auxiliary frame, be transported across the floor on which it has been assembled to an outer side of the building for its suspension immediately outward of the front thereof, thereby to facilitate its ready movement, usually a reasonable and relatively short distance, to the place of its installation. The screws connecting the posts of the wall element assembly to the auxiliary frame will then be withdrawn, releasing the frame from the wall element. The auxiliary frame is then returned for use in the assembly thereon of a further wall element. The movement of the wall elements from the place of their assembly to a position wherein they are presented to the outside of the building may be effected with the use of a cart having a horizontal supporting surface or the use of a car mounting a pivoted boom as previously described. The suspension apparatus employed, with which wall elements are moved on the outer side of the building, will preferably consist of a monorail trolley mounted in connection with an upper level of the building.

The preassembly of the individual wall elements on their frame will preferably take place on a table or a stand the upper surface of which will be preferably formed by roller elements. Where a cart is employed to move the wall element the upper surface or side thereof can likewise be provided with roller elements the level of which is at the same height as the roller elements of the assembling stand. This arrangement will facilitate a quick and easy transfer of an auxiliary frame bearing a wall element from the assembling stand onto the cart and likewise facilitate the return of the auxiliary frame from the cart to the assembling stand.

If a prefabricated wall element in connection with an auxiliary frame is to be moved by the car with the boom, the auxiliary frame is provided with a ball turntable mounted thereto the midpoint of which corresponds approximately to the center of gravity of the prefabricated wall element. A plate is fastened to this ball turntable and for the pick up of the frame and the prefabricated wall element the boom is pivotally connected to an outer portion of the plate and at the same time the piston of a piston-cylinder unit which is pivotally connected to the boom in an adjacent spaced relation to its outer end has the piston thereof pivotally connected to the plate at a location corresponding to the center of the ball turntable. With the frame and the prefabricated wall element so connected to the boom, the wall element can then be readily hoisted and swung into a horizontal position for its transport to and in front of the outer side of the building. At the outer side of the building, by virtue of the connection of the plate to the boom, the wall element and its frame can be equally swung until the wall element occupies a position about parallel to what would be the facade surface of the building. Since at this point, in accordance with the transport of the wall element, the longitudinal axis of this element still occupies a horizontal position, the element must be turned through 90° into its vertical position. Since the center of gravity of the preassembled wall element will approximately correspond with the center of the turntable, by virtue of the construction provided the 90° rotation of the wall element can be accomplished, for example by hand, since no great forces will have to be expended for this purpose. As previously indicated, when the longitudinal axis of the wall element is vertical, it is then hung on and suspended from the trolley provided on the outside of the building, whereupon the boom is released from the turntable and plate element of the frame. The wall element is then carried with the aid of the trolley to the location of its installation and there fastened to the building. The auxiliary frame is then released from the posts of the prefabricated wall element and brought back by the trolley, immediately of the building where optionally it may again be fastened to the boom of the car for return for further use or it can be pulled back into the building by hand.

The auxiliary frame is preferably constructed to be rectangular and consists, for example, of welded profiles including longitudinally extending side bars or spars bridged at their respective ends by an upper and a lower transverse bar or spar. Preferably the upper transverse spar can be provided with a portion embodying a transport eye which can be set at an angle to the remainder of the frame so that when a preassembled or prefabricated wall element is completed in connection with the frame and assumes a vertical position when presented at the outer side of the building the transport eye will be thereabove facilitating the hanging of the wall element and its frame vertically.

In the fabrication of the wall elements it is preferable that the arrangement provide that the tie bars or cross ties of the wall element have a slip fit relation to pins in connection with the posts. It suffices to fasten only the posts to the auxiliary frame since the remainder of the applied wall element will be securely in connection with the posts during transport of the wall element from its place of assembly to its place of installation. It is contemplated that any additional wall element components that may be desired will be preassembled with the posts and tie bars of the elements and held in connection with its posts.

The invention is explained in detail in the following with the aid of several examples of execution which may be seen with reference to the accompanying drawings wherein, FIG. 1 shows, in front view, a cut-out of a curtain wall of a building;

Figure 1:
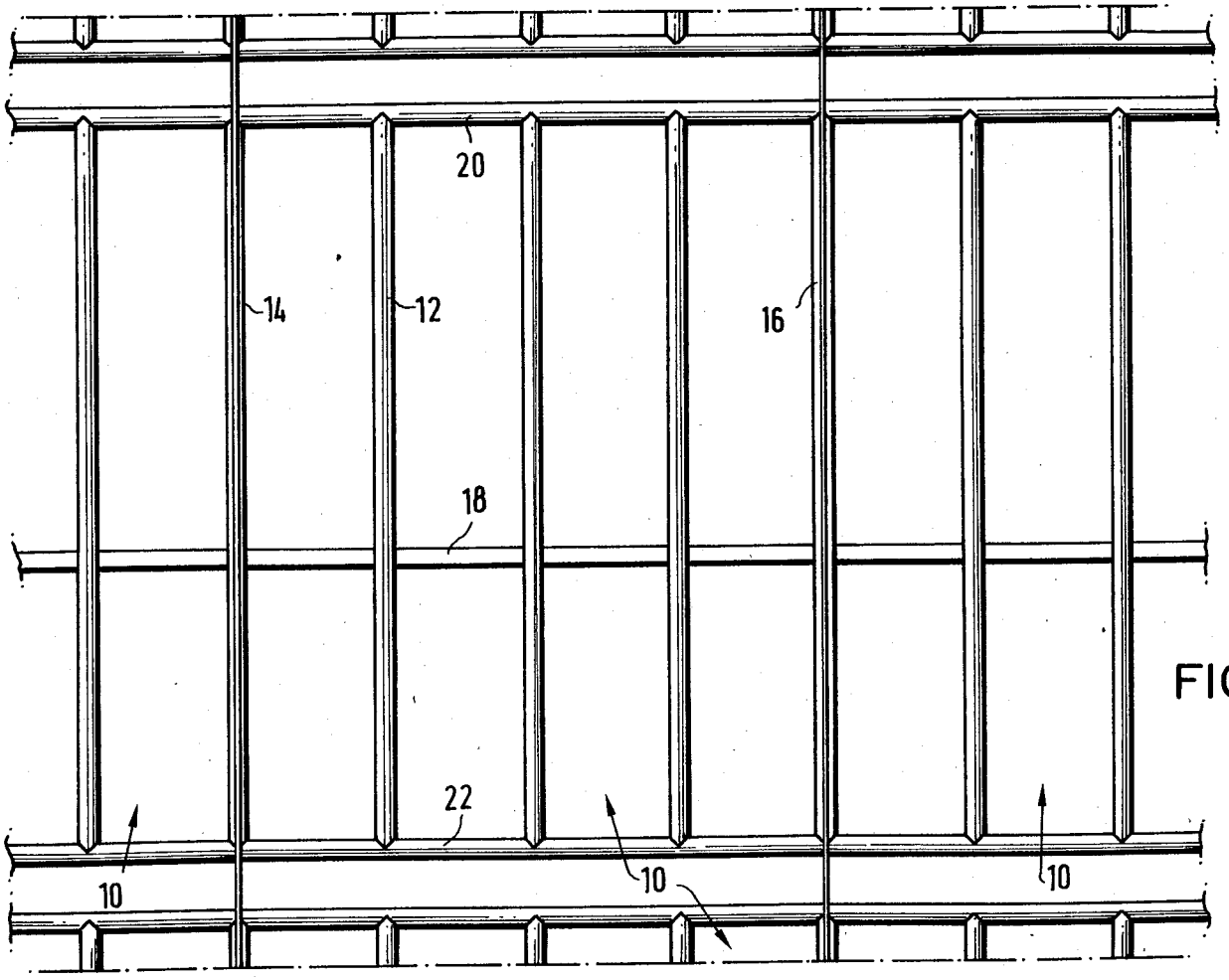

FIG. 1 shows, in front view, a section of a facade of a building, basically a curtain wall that is composed of wall elements 10. Each of the wall elements 10 exhibits a post and tie bar construction and comprises middle posts 12, an outer post 14 at the left thereof, an outer post 16 at the right thereof, middle tie bars 18, upper tie bars 20 and lower tie bars 22. In the case illustrated the wall element includes three middle posts 12 and one middle tie bar 18 and as a preferred embodiment of the invention has an area of extent of about 3 meters in width and 3.5 meters in height. In accordance with the invention the wall elements 10 are assembled on an auxiliary frame 34 within the frame of a building under construction, on a floor thereof, from posts and tie bars and following the assembly thereof the wall element is brought to the outside of the building and there fastened in place as required.

Figure 2:
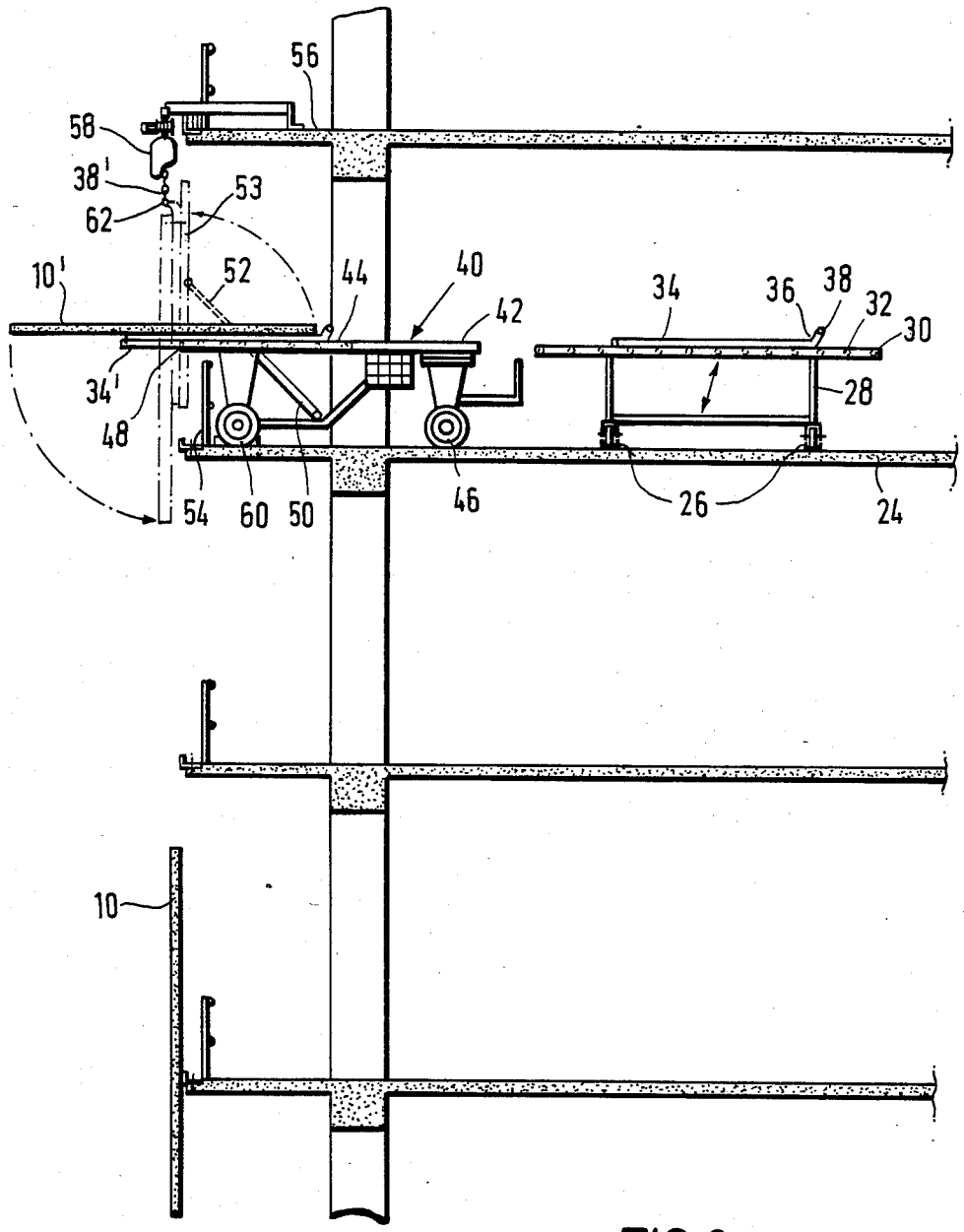
FIG. 2 shows a section through several stories of the building which is under construction, schematically illustrating therein apparatus in accordance with the invention and its function in carrying out the process of the invention.

More particularly, in this respect, attention is directed to FIG. 2 of the drawings. Here shown is a cross section through the building under construction which is to be provided with a curtain wall and also shown on a floor of such building are the devices or apparatus necessary to bring the wall element or wall elements which are preassembled or prefabricated on the auxiliary frame 34 to their place of installation. FIG. 2 illustrates an assembling stand 28 movably arranged on rails 26 in connection with and on the floor 24 of the building.

The stand 28 has a height that permits a convenient assembling procedure. On its upper side it presents longitudinally extending spars 30 transverse to which are roller elements 32. On these roller elements 32 there rests an auxiliary frame 34 on which a wall element is to be preassembled, immediately prior to its installation. What may be considered the upper end 36 of the auxiliary frame 34 is shown to be bent and provided with a transport eye 38. When a wall element is assembled on the frame 34, the bent end portion 36 is adjacent to and projects beyond that end portion of the wall element which is uppermost as installed. At the same time a substantial portion of the longitudinal extent of the wall element, approaching one-half thereof, projects beyond the opposite end portion of the frame. The benefit of the overhang of the assembled wall element will soon become obvious.

The assembling stand 28 will be positioned relatively close to the side portion of the building where the wall elements will be installed. Mounted on the floor 24 for movement between the stand 28 and the adjacent side of the building where the curtain wall is to be erected is a cart 40. As seen in FIG. 2 there is mounted on the cart 40 a frame 34' corresponding to the frame 34, on the top of which is attached a wall element 10' which has previously been preassembled on the stand 28. The height of the cart 40 corresponds to the height of the assembling stand 28.

The upper side of the cart 40 is defined by longitudinally extending transversely spaced spars 42 which are transversely bridged by rolls 44. The fact that a frame mounted on the upper surface of the stand 28 is based on rollers 32 and the upper surface of the cart provides rollers 44 at the same height, this enables that a frame, once it has a wall element assembled thereto, may be easily and quickly slid from the stand to the cart. An axle 46 of the cart 40 provided at the end thereof most adjacent the stand 28, in the arrangement shown, is steerable, making the cart readily maneuverable to and from a position immediately of the stand and to and from the relatively adjacent outer edge of the floor 24 which projects forwardly and outwardly of the side of the building in connection with which the preassembled wall elements will be installed. A railing 54 is mounted at and perpendicular to the floor 24 adjacent its outermost edge and a similar railing is provided in connection with and upstanding from each floor of the building adjacent its outermost edge. As will be seen, as the cart 40 is moved from the stand 28 to the outer edge of the floor 34, its wheels 60 in connection with an axle parallel to and spaced outwardly from the axle 46 are chocked immediately of the railing. At the same time the top portion of the cart projects over, in spaced relation to and beyond the railing 54.

Included between and hingedly coupled to the spars 42 by transversely disposed pivot means 48 is a frame 53, which forms the portion of the top of the cart 40 outermost from that end which positions adjacent the stand 28 to receive thereon a frame bearing a wall element 10 or 10'. When a frame mounting an assembled wall element is slid from the stand 28 onto the top of the cart 40, it will then be moved onto the frame 53 and temporarily secured thereto by releasable clamping means located in the vicinity of the pivot means 48.

A piston-cylinder unit 50 is pivotally connected at one end to a portion of the chassis of the cart 40 at a location in underlying spaced relation to its top portion 42, 44 to have the piston which projects from its opposite end pivotally connected to the frame 53 at a location spaced from the pivot means 48, in the direction of the end of the top portion of the cart which first receives thereon a frame bearing an assembled wall element. When the cart 40 is moved outwardly on the floor 24 to the position where its wheels are chocked as previously described, the piston cylinder will be energized to project the piston 52, thereby to pivot the frame 53 to a vertical position spaced immediately outward from the outer edge of the floor 24 and the protective railing 54 and clear thereof. At the same time, as will be obvious, the frame 34' and the wall element 10' will be oriented to be generally perpendicular to the plane of the floor 24 and substantially parallel to the adjacent side of the building to which the wall element must be applied.

As also shown in FIG. 2, a monorail trolley 58 is mounted on the projected end of the floor ceiling 56 of the building which is above the floor 24. As schematically illustrated, the trolley 58 embodies raising and lowering apparatus including a suspension cable at the lower end of which is a hook means 62. When the frame 34' is in its vertical orientation just described, the hook means 62 is engaged to the frame through the transport eye 38'. At this point one need merely release the clamping means which has temporarily connected the frame 34' to the frame 53. Once this is achieved, the auxiliary frame 34' may be easily pressed outward from and movable laterally of the frame 53, to its place of installation, aided by the ability of the monorail trolley 58 to move in a direction parallel to the outer surface of the building under construction. As will be readily obvious, the distances through which the frame 34' must be moved once it is positioned outwardly of the building, are relatively short and the guidance of the frame and the wall element 10' which it bears may be assisted by assemblers or workers who may stand inside the railings provided at the side of the building where the wall elements will be applied.

Attention is particularly directed to the fact that by reason of the wall elements assembled on the auxiliary frame having a relative dimension to project outwardly and beyond the frame as it is brought to the side of the building for installation purposes, the movement of the frame 34' together with the frame 53 to a vertical orientation at the outer side of the building may be achieved with a very modest amount of effort.

Figure 3:
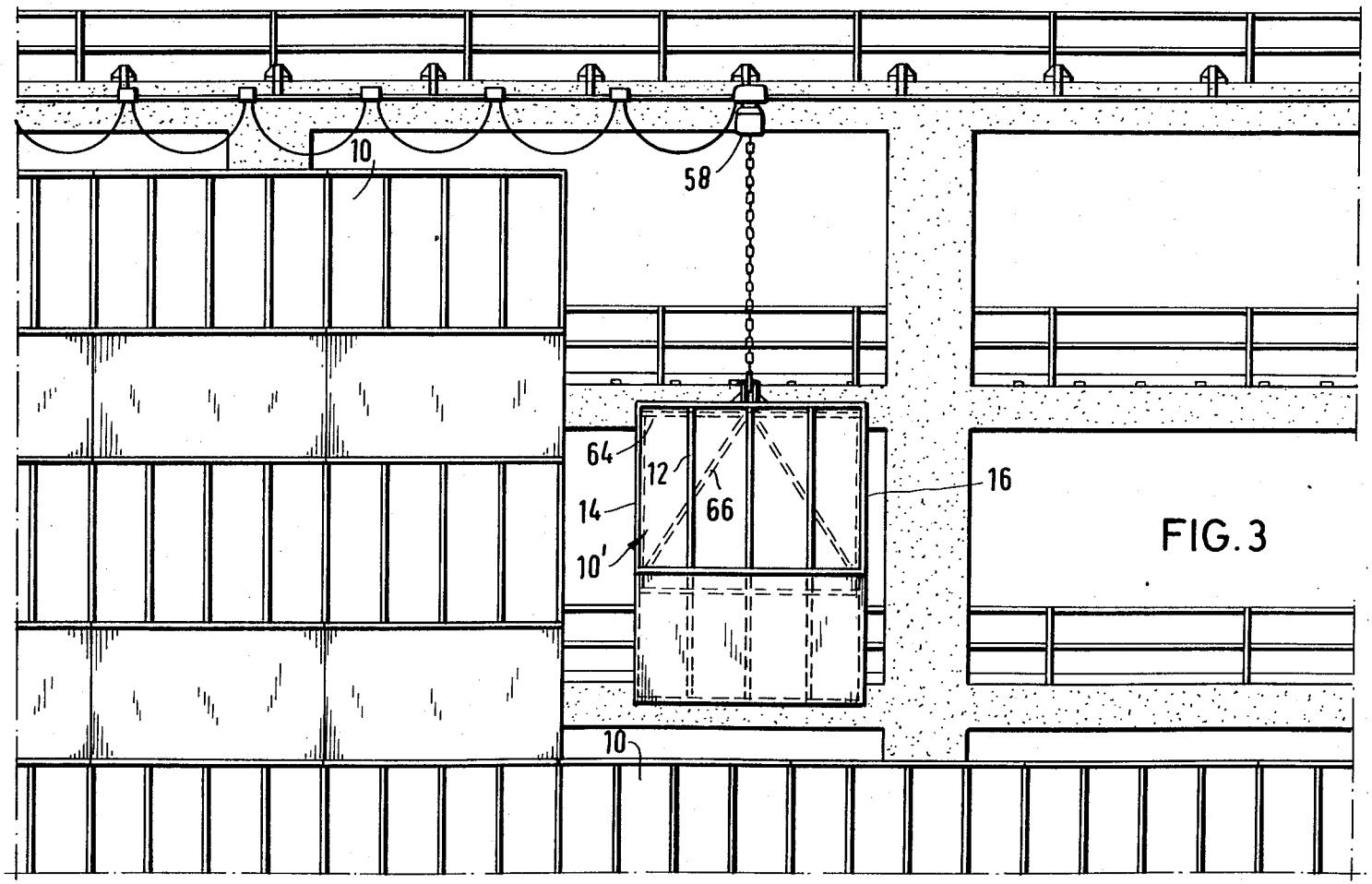
FIG. 3 shows, in front view, a partially assembled curtain wall and a further wall element in process of being applied.

FIG. 3 is a front view of the side of a building shown in cross section in FIG. 2 exhibiting a number of the wall elements 10 installed and the wall element 10' of FIG. 2 suspended from the trolley 58 and in the process of being moved to the left and downward where it is to be seated to an underlying wall element and connected to the building to form a continuation of the portion of the curtain wall already in place. FIG. 3 reveals, in broken lines, that included in the frame 34' behind the wall element 10' are a spar 64 and struts 66 as well as a lower spar (not visible) which is parallel to the spar 64. Only the posts 12, 14 and 16 of the wall element are fastened to the upper spar 64 and the lower spar which is not shown. The tie bars of the wall element are not per se connected to the auxiliary frame in any respect. The tie bars are framed by and mounted to the posts and made stable as to their position in this manner.

Figure 4:
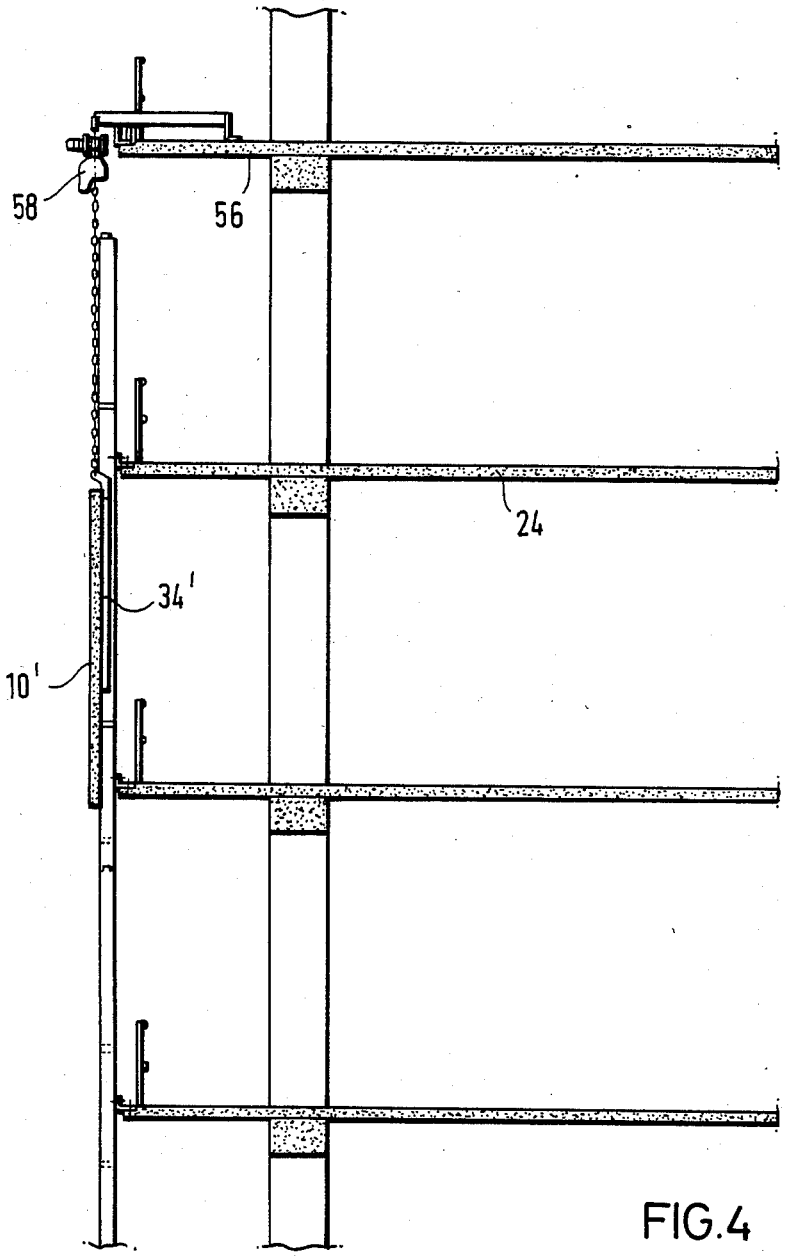
FIGS. 4 to 8 show schematic representations of various process steps.

FIG. 4 shows a section through the building corresponding to that shown in FIG. 2 demonstrating the wall element 10' in the course of its movement, with the aid of the trolley 58, both in horizontal and in vertical direction. As seen, the wall element 10' is still fastened to the frame 34'.

Figure 5:
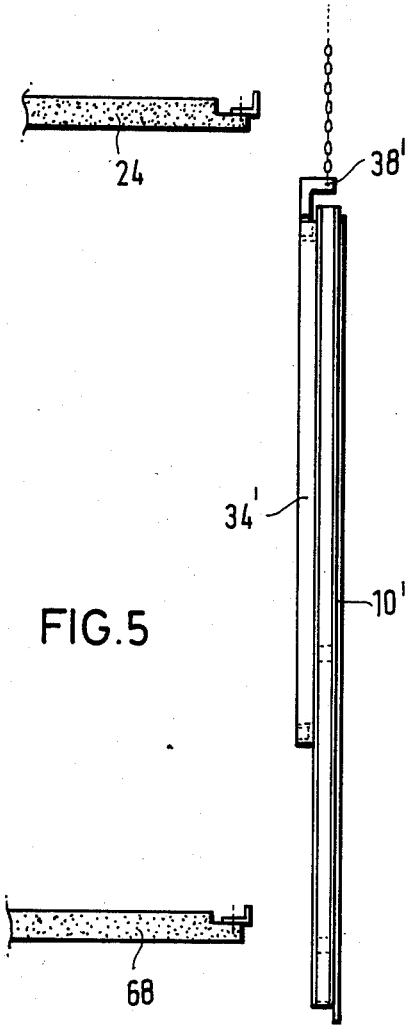

FIG. 5 shows, on a larger scale, an intermediate position of the wall element 10' as it is directed to its place of installation, this position corresponding approximately to that shown in FIG. 4.

Figure 6:
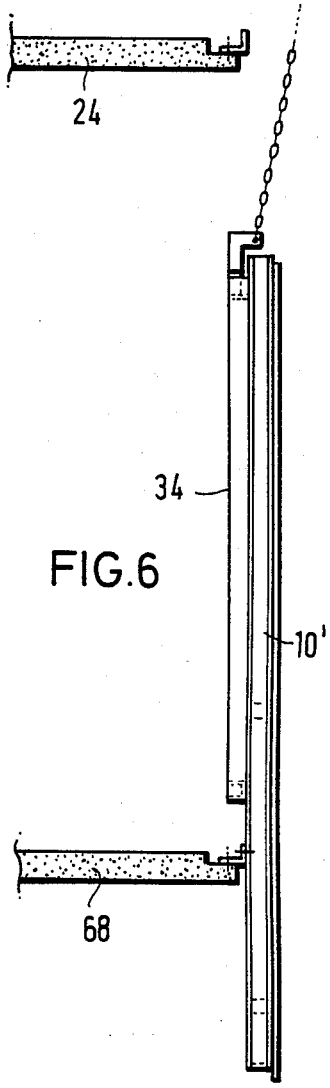

FIG. 6 shows the same wall element 10' with the posts thereof fastened to a floor ceiling 68 of the building which is below the level of the floor 24 and the auxiliary frame 34' still joined with the posts of the wall element 10'.

Figure 7:
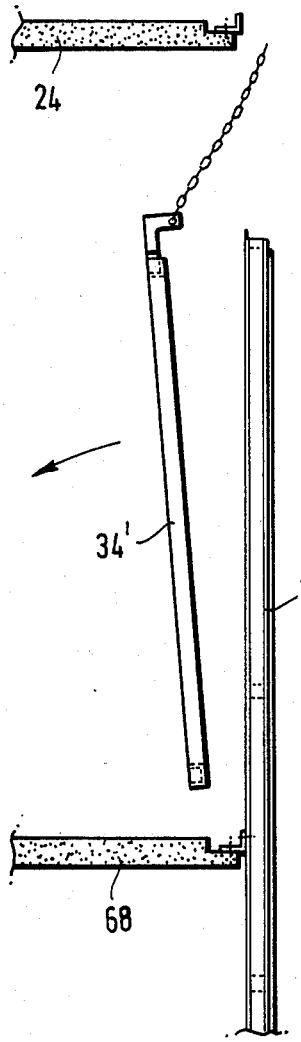
Figure 8:
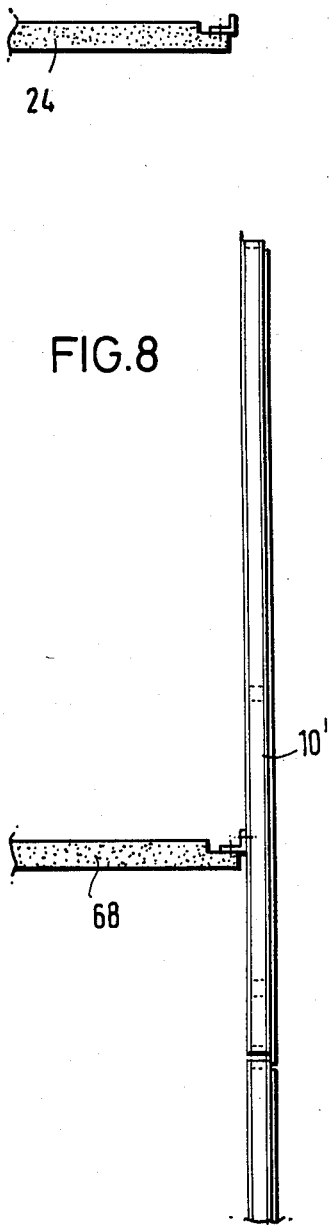

FIG. 7 shows the release of the frame 34' from the wall element 10' subsequent to disengagement of the means which previously connected the posts to the frame. The frame 34' is now free to be pulled away from and guided clear of the wall element 10' as it is lifted upwardly by the suspension means in connection with the trolley 58 to the level of the floor 24. At this level the frame 34' can once more be clamped to the frame 53, which is presented in a vertical position at the outer side of the building adjacent thereto. Once the frame 34' is clamped to the frame 53, the piston 52 is retracted to bring the frame 53 and the frame 34' back to a horizontal position. Then, on release of the holding clamps frame 34' may be slid directly over the rollers 44 and onto the rollers 32 of the assembling stand 28, which will at this point have the top thereof free for its reception. Having reached the assembling station, the frame 34' can once more be used to assemble thereon a wall element comprised of posts and tie bars, and, if desired, glazing and facade panels, thereby to provide a further prefabricated or preassembled wall element.

Figure 9:
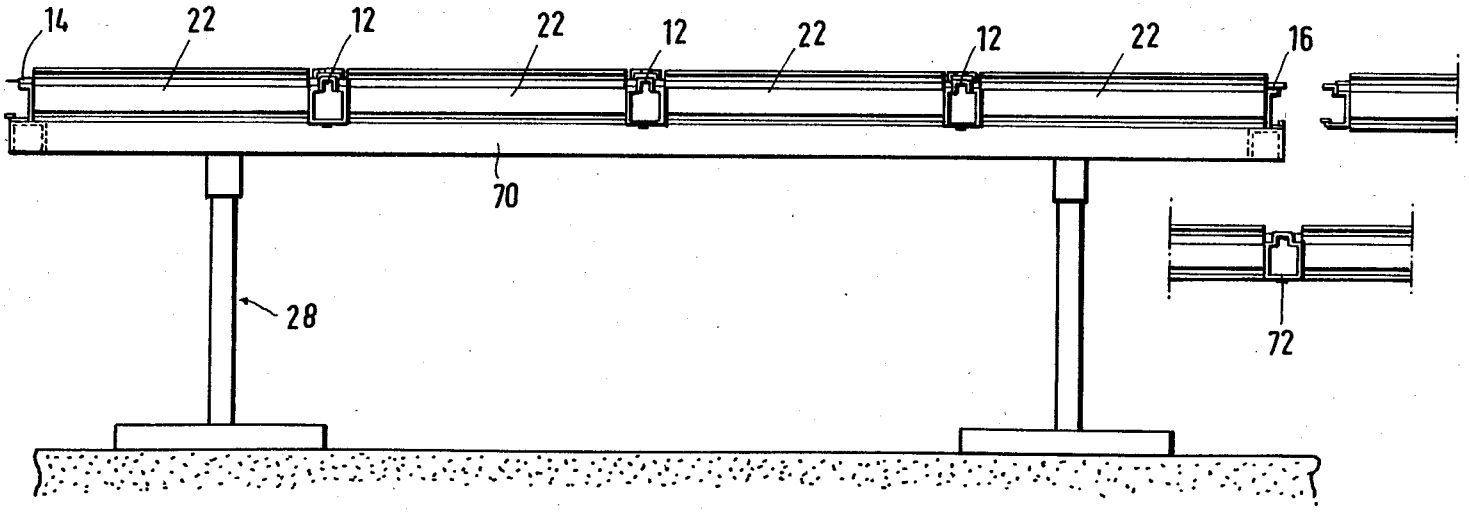
FIG. 9 shows, in front view, an assembling stand with a preassembled wall element thereon.

FIG. 9 shows a front view of an assembling stand 28 on the top of which rests an auxiliary frame 70 to the upper surface of which has been joined, by screws, the middle posts 12 as well as the left post 14 and right post 16 of a wall element 10. As seen in cross section, the middle posts 12 have a closed profile while the outer posts 14 and 16 have an open profile. The posts 14 and 16 are so constructed that when two of the wall elements 10 are brought together in side by side relation, in the joining thereof an outer post 14 and an outer post 16 yield a post having a closed profile. Tie bars 18, 20 and 22 are provided between adjacent posts of the wall element in the manner shown in FIG. 1, the lower tie bars 22 being visible in FIG. 9.

Figure 10:
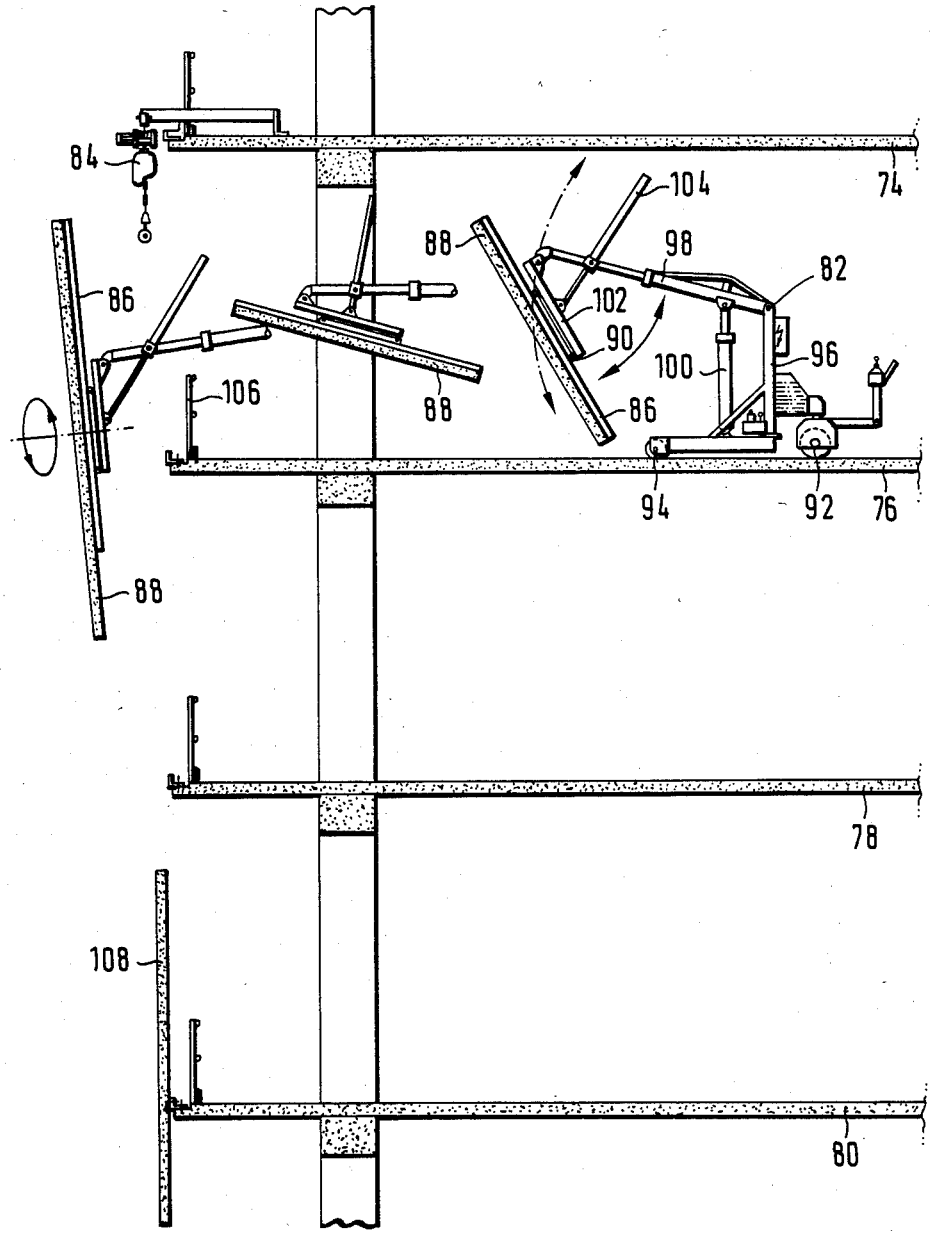
FIG. 10 is a section through several stories of a building similar to that illustrated in FIG. 2 schematically showing other apparatus for carrying out the function of the apparatus seen in FIG. 2.

FIG. 10 of the drawings shows a vertical section of a building at a stage similar to that of the building of FIG. 2. In this case the building is shown to include floor ceilings 74, 76, 78 and 80. Posts, tie bars, glazing, facade panels and sealing means of a curtain wall of a building facade which are to be preassembled on a frame into wall elements are stored on the floor ceiling 76. Also provided on the same floor, for movements thereacross, is a car 82 with the aid of which each wall element which is preassembled can be transported from the point of its assembly the short distance required to position it beyond the floor railing 106 in front of the outside of the building. There the wall element, through the medium of the frame on which it has been preassembled, may be suspended from a trolley 84, by means of which it may be carried to its place of installation.

More specifically, on the floor 76 the individual parts which form a wall element are assembled on an auxiliary frame 86. As in the assembly process previously described, only the posts of this wall element 88 which has been assembled, which posts are to be positioned vertically on the building to which they attach, are connected to the auxiliary frame 86, in this case by screws. The auxiliary frame 86 differs from the frame 34 and the frame 34' in that it mounts thereon, to position about at the center of gravity of each wall element 88 which is applied thereto, a ball turntable 90 providing thereon means enabling its eccentric suspension.

The transport car 82 comprises a steerable chassis 92 conventionally supported by wheels 94 and mounting to extend upwardly and perpendicular thereto a column 96. A boom arm 98 is provided which has one end thereof pivotally connected on and to the upper end of the column 96. The vertical shifting of the boom arm 98 about its pivot is accomplished by way of a hydraulic piston-cylinder unit 100 the lowermost end of which is based on an underlying portion of the chassis 92. On the free end of the boom arm 98 is an arrangement and construction by means of which the boom arm is provided with a pivotal connection to a plate 102, adjacent an edge portion thereof, which plate is connected in turn to the ball turntable 90. The cylinder portion of a piston cylinder unit 104 which is pivotally connected to the boom arm 98, at a location adjacent and spaced from its end remote from the column 96, has the projected end of its piston rod pivotally connected to the plate 102 at a point in line with the center of the ball turntable 90. As will be obvious from FIG. 10, on projection of the piston rod of the piston-cylinder unit 104, the frame 86 and the wall element assembled thereto can be pivoted on and with respect to the outer end of the boom arm 98, once they are connected as here described.

For a pressembling of a wall element 88, an auxiliary frame 86 is emplaced on a suitable stand which provides its support. The wall element 88 is then assembled on the frame in a manner that the posts which extend longitudinally of the wall element are attached to the transverse spars of the frame by screws. In the preassembly of the wall element 88 the dimensional proportions of the wall element will be made generally in correspondence with the dimensional proportions of the wall elements 10, 10' and the wall element will project beyond the frame 86 at one end as described previously with respect to the showing in FIG. 2. After the wall element 88 has been preassembled and connected to the frame 86, the assembly so provided is rotated through 180°, by suitable means, so that the auxiliary frame 86 is uppermost and the ball turntable 90, including the plate 102 in connection therewith, can then be joined in pivotal connection to the boom arm 98 of the transport car 82. At the same time the projected extremity of the piston rod in connection with the piston of the piston-cylinder unit 104 is connected to the plate 102 and the ball turntable. In order that the movement of the frame 86 and the wall element 88 be facilitated, in its movement by the car 82 between the floor ceilings 74 and 76 and over the protective railing 106 at the outer edge of the floor 76, the piston rod of the piston-cylinder unit 104 is retracted and the boom arm 98 appropriately positioned so that the wall element 88 is in a position in which it approaches the horizontal. With the wall element 88 nearly horizontal, the transport car 82 is then caused to travel the relatively short distance required to position the wall element 88 over and outwardly of the railing 106 and the adjacent side of the building so that a swinging of the wall element, together with its frame into a vertical position by means of the projection of the piston rod of the piston-cylinder unit 104 is now possible (FIG. 10).

It is noted that in the support and in the movement of the wall element 88 in connection with its frame 86 from the assembly stand to the outside of the building the wall element has been so positioned that its longer extent, which is to orient vertically in the application thereof to the building, is arranged to run parallel to the outside of the building.

Once the wall element 88 and the frame to which it connects has been positioned out over the railing 106 and swung into the vertical, the wall element and its frame may then be turned by hand through 90°, the same being accommodated by the ball turntable 90, so that the posts of the wall element assume a vertical position. At this point the frame 86, and correspondingly the element 88 thereon, can be suspended in connection with the lower end of the suspension cable embodied as part of the raising and lowering apparatus of a trolley 84 which is mounted to position outwardly of the outermost edge of the floor ceiling 74 which is at a level above the floor ceiling 76 in the building under construction. At this point the boom arm 98 and the piston of the cylinder 104 are released from the plate 102 and the turntable 90 and the transport car 82 is withdrawn. The wall element 88 can now be guided by hand to its place of installation, for example on the floor ceiling 78 where it will then be positioned over a wall element 108 which has been previously installed in connection with the floor ceiling 80, below the floor ceiling 78.

Once the wall element 88 has been installed, the frame 86 is released from the posts thereof and then brought back over the crane or trolley track which is here provided to the transport car 82, to which it is connected and returned in obvious manner to the assembling table for a repetition of the assembly thereon of a wall element.

Figure 11:
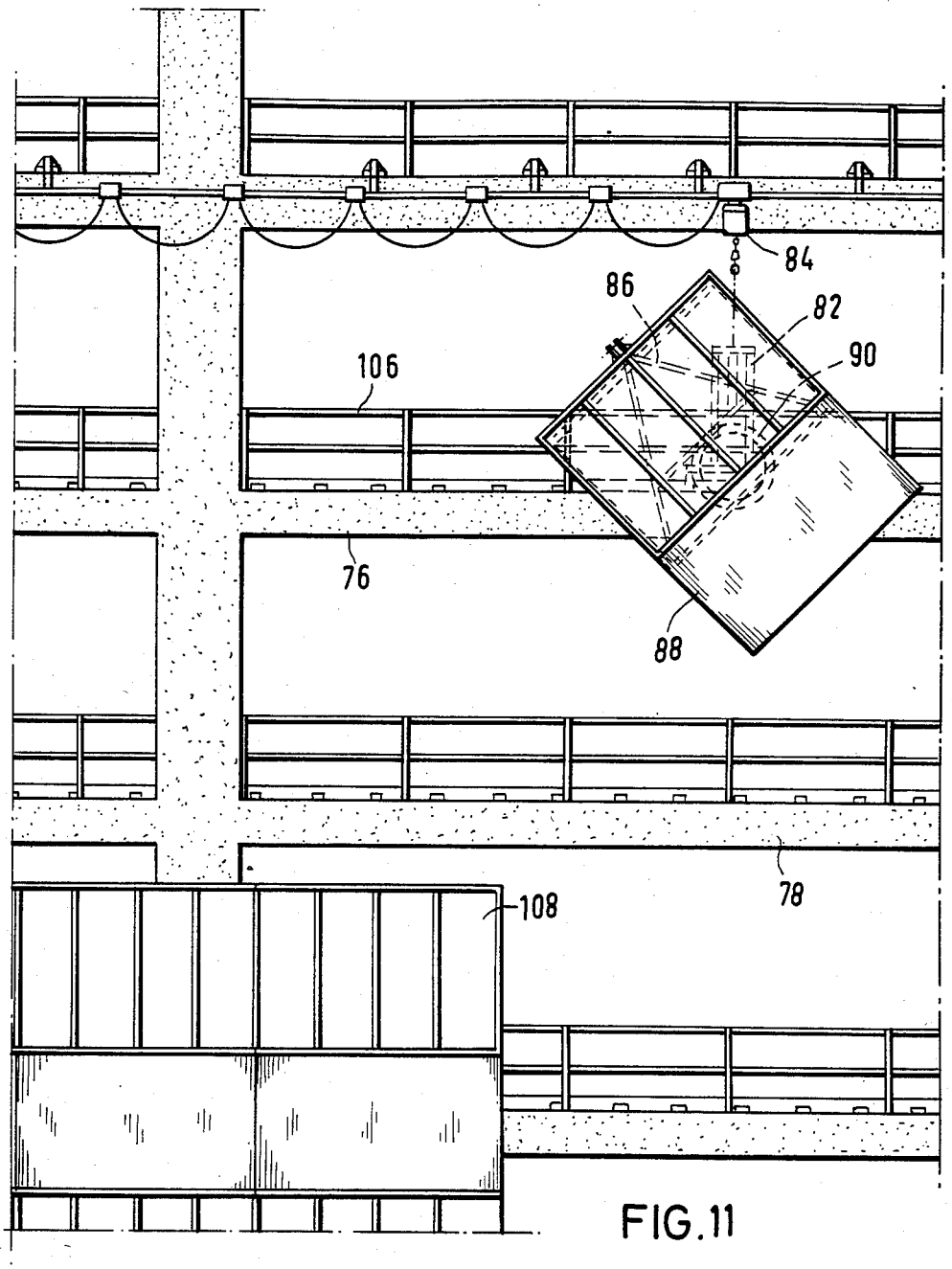
FIG. 11 shows, in front view, a wall element present in an intermediate position in the process of its installation.

FIG. 11 shows, in front view, a further view of the procedure described with reference to FIG. 10. In FIG. 11 there is exhibited the wall elements 108 and the wall element 88 in the course of its movement to its installation place, at a time when the wall element 88 is still joined, by way of the turntable 90 of the auxiliary frame to which it mounts, with the transport vehicle 82. The wall element is shown in the process of it being turned precisely through 90° in order that it may be suspended on the trolley 84 and then released from the transport car 82 so that it may be moved to its place of installation.

From the foregoing one may readily see the present invention does in fact provide apparatus and a process for effecting a safe, quick and efficient installation of a curtain wall, one which solves the problems of the prior art.

To summarize, the invention basically provides for the installation of curtain walls using prefabricated wall elements of reasonable size provided in the interior of the building where the construction is taking place. The wall elements are provided on an existing floor of the building and carried individually across the floor and presented immediately of an outer side of the building on a car or cart, at which point each is hung on a suspension apparatus by means of which it is presented for installation and while still so hung it is fastened in connection with the building at its required location.

The suspension means utilized is preferably a monorail trolley device and the wall elements are preferably a post and tie bar construction preassembled on an auxiliary frame and of a nature to facilitate their connection into a curtain wall and to satisfy the requirements for ease in application of sealing and providing expansion joints.

The invention also affords features of advantage in the nature and character of the construction and mode of usage of the carts and cars employed for movement of the wall elements quickly and safely from the interior to the exterior of a building. Such details are found in the foregoing summary and description of exemplary invention embodiments.

An important aspect of the procedures of the invention is that the installation is aided by apparatus in and in immediate connection with the building and persons working from secure positions on various floors of the building to which the curtain wall is being applied.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which the exclusive property or privilege is claimed are defined as follows:

1. A process for assembling and installing a curtain wall on a frame of a building wherein one or more floor portions have been established at an above ground level characterized in that components of of the curtain wall, including posts and tie bars, glazing, facade panels, and the like, are delivered to and provided within the building, at a level represented by a floor portion thereof, on said floor portion a plurality of said components including posts and tie bars are assembled into a section of said curtain wall, said section is secured to an auxiliary structure and moved therewith, by means of a mobile carrier, across said floor portion to a location thereon adjacent an exterior of said building where said auxiliary structure is engaged to transfer means mounted on the frame of said building, positioned immediately outward thereof, said auxiliary structure together with the section of the curtain wall secured thereto are then moved, by means of said transfer means, in a path substantially adjacent to the exterior of the building to the location required for the curtain wall's application, where the curtain wall is pulled into its required position and there fastened in connection with the frame of said building, said auxiliary structure is then released from the section of said curtain wall so installed and, utilizing said transfer means to which it is still engaged, moved back to a floor portion of said building for similar use in a similar manner.

2. The process as in claim 1 wherein, within said building and its frame and on said floor portion thereof, said wall section is assembled and releasably secured to said auxiliary structure and together therewith caused to assume a substantially horizontal attitude in the movement thereof to the exterior of the building and on reaching a point adjacent said exterior induced to move to a vertical position and into an adjacent and substantially parallel relation to the exterior of said frame and the building of which it forms a part, prior to said movement thereof by said transfer means.

3. The process as in claim 2 wherein on the engagement thereof to said transfer means, said auxiliary structure is suspended therefrom to place said section of said curtain wall in that orientation in which it is required to be installed in connection with and to form a part of the exterior facade of said building.

4. A process as in claim 1 wherein the auxiliary structure utilized is a frame and said section of said curtain wall is achieved by assembling posts and tie bars on said auxiliary frame together with such additional components as are required to be secured to said posts and/or tie bars and said posts are mounted in a releasably secured relation to said auxiliary frame.

5. A process as in claim 1 wherein said auxiliary structure is releasably secured to said section of a curtain wall, moved therewith over said floor of said building on a supporting structure a part of which provides a pivoted base to which the assembly comprised of said auxiliary structure and said section of said curtain wall are releasably clamped, by means of the pivoting of said pivoted base, said assembly is brought to a vertical position exterior to the building and hung from suspension apparatus forming part of said transfer means to place said section of the curtain wall on said auxiliary structure in the orientation required for its installation on said building.

6. A process as in claim 1 wherein said auxiliary structure and the section of the curtain wall applied thereto are moved over the exterior of the building, in adjacent relatively closely spaced relation thereto, in both lateral and vertical directions, as required, and the application thereof to said transfer means and the removal of the section of the curtain wall from its auxiliary structure is achieved by persons and/or equipment positioned within the limits of said building.

7. A process according to claim 1, wherein said auxiliary structure is provided in the form of a frame, including initially placing said auxiliary frame on rollers forming the upper side of an assembly structure, assembling said section of a curtain wall of posts and tie bars applied to said auxiliary frame, releasably engaging only a limited portion of said posts and tie bars to said frame, attaching other of said components to said posts and/or tie bars if required, and, using said rollers as a base, sliding said auxiliary frame and said section of a curtain wall engaged thereto onto a mobile unit, to a pivotable portion thereof to which they are clamped, moving said mobile unit to the exterior of said building, and then pivoting said pivotable portion thereof to move said auxiliary frame and the engaged wall section to a substantially vertical orientation, at which time said auxiliary structure is engaged to said transfer means.

8. A process as in claim 1, wherein said auxiliary structure has the form of a frame having at one face thereof, remote from that to which a section of a curtain wall is applied, a turntable device and a mobile support unit is provided which mounts a pivotally related boom structure, including connecting said turntable device in pivotable relation to said boom structure subsequent to the application of a curtain wall section in releasable connection with said auxiliary frame, utilizing said mobile support unit to move said auxiliary frame and wall section connected thereto over said floor portion to position said frame and said connected wall section at the exterior of said building and to pivot said auxiliary frame to a vertical position thereby to orient said wall section in substantially that attitude required for its installation in connection with said building, engaging said auxiliary frame to said transfer means in a suspended relation thereto and disconnecting said boom to free said auxiliary frame and the section of the curtain wall releasably attached thereto from said mobile unit, thereby to enable the movement thereof by said transfer means to the place required for installation of said wall section as part of the curtain wall of said building.

9. A process for use in the assembly and installation of a curtain wall of a building characterized by providing components of sections of a curtain wall on a selected level of the frame of a building as represented by a floor thereof, providing an auxiliary frame on such floor, assembling selected of said components of sections of a curtain wall on said auxiliary frame to form a section of said curtain wall, releasably securing said section to one face of said auxiliary frame, moving said auxiliary frame over said floor to a position immediately of the exterior of the building to which the said section is to apply, hanging said auxiliary frame from suspension apparatus installed on the building, utilizing said suspension apparatus moving said auxiliary frame to that position at the exterior of the building to which said section applies, for its receipt and application by a person or persons within the building, releasing said auxiliary frame from said section of said curtain wall and returning it to said selected level of said building utilizing said suspension means, for retrieval by a person or persons on said floor thereof and the assembly thereon and releasable attachment thereto of a further section of the curtain wall to be installed on said building.

10. A process for use in the assembly and installation of a curtain wall to form part of a building comprising providing elements of sections of the curtain wall on a selected level or levels of the frame of the building corresponding to an installed floor, floors or portions thereof, on one such floor interconnecting selected of said elements to form a section of the curtain wall and releasably securing a portion of said section to an auxiliary device to produce a temporary assembly thereof, moving said assembly over said one such floor to a location adjacent the exterior of said frame and correspondingly the building construction of which it forms a part, suspending said assembly from means to carry and maintain a path of movement thereof immediately of and substantially parallel to said building construction, by such means moving said assembly to a place at which the installation of said section is required, at the place and from a position on said building construction establishing and fixing said section to form a part of said curtain wall of said building, detaching said auxiliary device from said section and returning it to one of said floors for the reuse thereof for similar purpose and in similar fashion.

11. A process according to claim 10 wherein said assebmly is easily and quickly moved over said one such floor, over support means comprising roller means, and adjacent the exterior of said building construction, oriented in a substantially vertical plane or planes relatively immediately adjacent to and outwardly of said building construction for the movement of said section of said curtain wall to said place of its installation to form a part of said curtain wall of said building.

12. A process according to claim 10 wherein said assembly comprised of said section of said curtain wall and said auxiliary device is moved over a surface comprising roller means, from the place of the assembly thereof, and over the surface of a support comprising roller means for the continuing movement thereof to the exterior of the building construction and said section of said curtain wall is so positioned relative said auxiliary device and said surface of said support as it reaches said location adjacent the exterior of the building construction to have a portion thereof project outwardly of and beyond said support to facilitate its movement to a substantially vertical orientation for its connection to said suspending means and movement thereof to the place of its installation.

13. A process as in claim 10 wherein said auxiliary device is provided with an interconnected turntable and on the achievement of said assembly said turntable is interconnected with a mobile carrier by means providing for a generally universal adjustment thereof and of said assembly as said carrier is used to move said assembly over said one such floor to the exterior of said building construction, said assembly is positioned thereby outwardly of said building construction and rotated to position said section of the curtain wall which forms a part thereof in the general attitude it must assume when presented at the place at which its installation is required, preliminary to its movement to such place by said suspension means.

14. A process as in claim 13 wherein said assembly is established in a generally horizontal attitude as it is moved over said floor and generally so maintained as it is advanced by said carrier until it is swung outwardly and immediately of the exterior of said building with what is normally its vertical axis in use positioned generally horizontally and substantially parallel to the outer side of the building and the assembly is then rotated to move said axis into its required vertical position for connection of said assebmly to said suspension means preliminary to the movement thereof to its place of installation.

* * * * *

UNITED STATES PATENT AND TRADEMARK OFFICE

CERTIFICATE OF CORRECTION

PATENT NO. : 4,555,890

DATED : December 3, 1985

INVENTOR(S) : Fritz Gartner

It is certified that error appears in the above-identified patent and that said Letters Patent is hereby corrected as shown below:

Col. 6, line 14, "34" is corrected to read -- 24 --.

Signed and Sealed this

*Twenty-second* Day of *April 1986*

[SEAL]

*Attest:*

DONALD J. QUIGG

*Attesting Officer*

*Commissioner of Patents and Trademarks*